US006286315B1

(12) United States Patent
Staehle

(10) Patent No.: US 6,286,315 B1
(45) Date of Patent: Sep. 11, 2001

(54) AIR INDEPENDENT CLOSED CYCLE ENGINE SYSTEM

(75) Inventor: Charles Michael Staehle, Palm Beach Gardens, FL (US)

(73) Assignee: Submersible Systems Technology, Inc., Rivera Beach, FL (US)

( * ) Notice: Subject to any disclaimer, the term of this patent is extended or adjusted under 35 U.S.C. 154(b) by 0 days.

(21) Appl. No.: 09/259,754

(22) Filed: Feb. 27, 1999

Related U.S. Application Data

(60) Provisional application No. 60/076,779, filed on Mar. 4, 1998.

(51) Int. Cl.[7] ..... F01K 25/06
(52) U.S. Cl. ..... 60/649; 60/685
(58) Field of Search ..... 60/649, 431, 322, 60/685, 272

(56) References Cited

U.S. PATENT DOCUMENTS 3,658,043 * 4/1972 Hoffman ..... 123/119 A
4,674,463 * 6/1987 Duckworth et al. ..... 123/570
4,698,974 * 10/1987 Wood ..... 60/649 X
5,016,599 * 5/1991 Jubb ..... 123/570
5,177,952 * 1/1993 Stone ..... 60/39.05
5,613,362 * 3/1997 Dixon ..... 60/649

* cited by examiner

*Primary Examiner*—Hoang Nguyen

(57) ABSTRACT

A closed-cycle heat engine system that operates within a sealed, gas tight enclosure uses $CO_2$, water vapor and $O_2$ in the intake and compression cycles, injecting fuel to promote combustion and using the high temperature and pressure product $CO_2$ and water vapor as the post combustion working gas. By controlling the individual partial pressures of the $O_2$ and $CO_2$ in the enclosure and allowing $H_2O$ vapor to exist in saturation within the enclosure the gamma value of the ingested gas can be controlled to meet engine design and operating requirements. Excess $CO_2$ produced by combustion is compressed, removed from the enclosure, liquefied and stored in a separate tank. Noncondensable gasses are returned to the engine enclosure where they are recycled to promote system efficiency. Excess water produced by combustion is also removed from the enclosure and stored in a separate tank.

1 Claim, 2 Drawing Sheets

CLOSED CYCLE ENGINE SCHEMATIC DIAGRAM

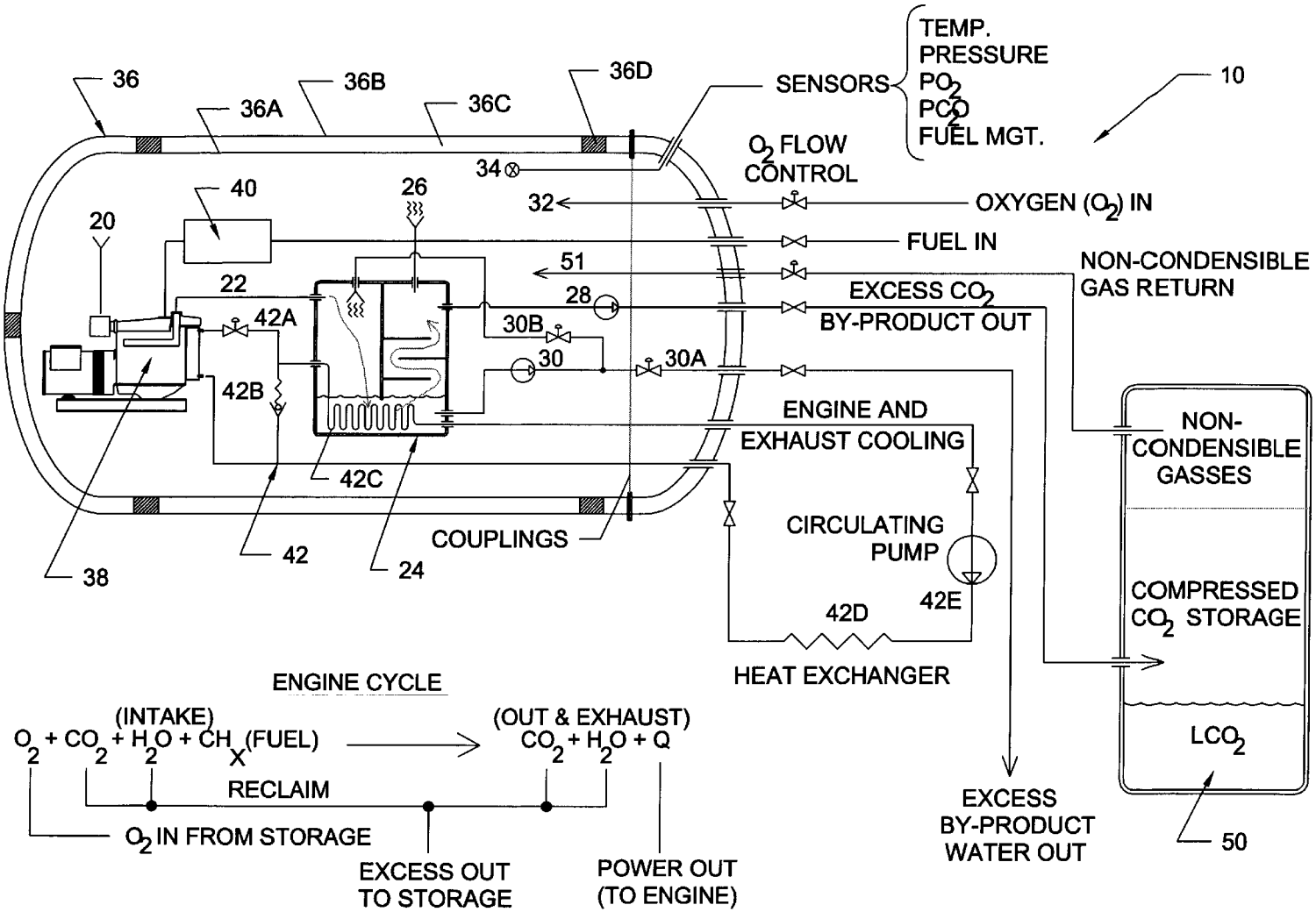
FIGURE 1. CLOSED CYCLE ENGINE SCHEMATIC DIAGRAM
(SEE LEGEND, FIGURE 2.)

10 AIR INDEPENDENT CLOSED CYCLE ENGINE SYSTEM.

20 ENGINE INTAKE: $PCO_2 + PO_2 + PH_2O$ + (FUEL) $CH_X$

22 EXHAUST OUT OF ENGINE: $CO_2 + H_2O$

24 EXHAUST COOLER, $H_2O$ CONDENSER & CONDENSATE RESERVOIR.

26 $CO_2$ EXHAUST OUT OF COOLER – INTO ENCLOSURE.

28 EXCESS $CO_2$ COMPRESSOR – OUT OF COOLER PLENUM.

30 CONDENSATE ($H_2O$) PUMP, OUT OF ENCLOSURE, 30A, OR RECIRCULATED FOR EXHAUST COOLING, 30B.

32 MAKEUP $O_2$ – INTO ENCLOSURE.

34 SENSOR CONTROL MODULE: ENCLOSURE 36A TEMPERATURE AND ABSOLUTE PRESSURE, $PO_2$ & $PCO_2$ SENSORS AND PROCESS CONTROL; OPERATES $CO_2$ COMPRESSOR, $H_2O$ VALVES AND $O_2$ FLOW CONTROLS.

36 PRIMARY PRESSURE VESSEL ASSEMBLY: 36B ENCLOSES 36A FORMING AN EVACUATED ANNULUS 36C BETWEEN; AND INCORPORATES RESILIENT SOUND AND VIBRATION ISOLATION 36D.

38 ENGINE: POWER OUTPUT OPERATES GENERATOR, DRIVE SHAFT, PUMP, ETC.

40 ENGINE FUEL CONTROL MODULE.

42 ENGINE AND EXHAUST COOLING SYSTEM WITH ENGINE TEMPERATURE REGULATOR VALVE 42A, BYPASS VALVE 42B, INTERNAL HEAT EXCHANGER 42C, EXTERNAL HEAT EXCHANGER 42D AND CIRCULATING WATER PUMP 42E.

50 SECONDARY PRESSURE VESSEL FOR STORAGE OF LIQUID $CO_2$ AND NON-CONDENSABLE GAS.

51 NON-CONDENSABLE GAS AND $O_2$ RETURN PIPING AND CONTROL VALVE.

(SEE FIGURE 1, CCE SCHEMATIC DIAG.)

FIGURE 2: LEGEND

AIR INDEPENDENT CLOSED CYCLE ENGINE SYSTEM

This application claims the benefit of Provisional Patent Application Ser. No. 60/076,779 filed 1998, Mar. 04, 1998.

BACKGROUND

1. Field of Invention

This invention relates to expansion heat engines, both internal and external combustion, specifically to allow such engines to operate in an enclosed environment where ambient air is not available or where the exhaust gases and combustion byproducts must be contained. Example of such environments are: submarines and autonomous underwater vehicles; underwater and subterranean power generating systems; in space or at very high altitudes.

In a conventional air-aspirated internal combustion engine air, ingested on the intake stroke, is composed of Nitrogen ($N_2$), Oxygen ($O_2$) and water vapor ($H_2O$). This gas is mixed with fuel and ignited in combustion to reduce the fuel and $O_2$ to $CO_2$ and $H_2O$ and produce sensible heat. This mixture of $N_2$, $CO_2$ and $H_2O$ vapor becomes the "working gas" and ultimately the exhaust. The heat of combustion raises the temperature and pressure of this working gas, which can be mechanically harnessed to do work. Of the working gas in an air-aspirated engine ($N_2$, $CO_2$, $H_2O$, residual $O_2$ and trace gasses) $N_2$ is the principal working gas component. It is possible to separate the $N_2$ from the combustion byproducts in the exhaust, ($CO_2$ and $H_2O$) and recirculate this "reconditioned" $N_2$ in a closed loop or cycle by replenishing the $O_2$ and introducing fuel as required to meet engine power requirements. The molecular mass, equivalent specific heat and gamma value of the initial gas charge ingested by the engine must be replicated on each intake stroke if engine performance is to be maintained as designed. The excess $CO_2$ and $H_2O$ in the exhaust must be removed or "scrubbed" from the exhaust in order for the $N_2$ to be recycled as the principal working gas. It is the complexity, inefficiency and cost of separating and removing the byproduct $CO_2$ from the $N_2$ exhaust that has been the limiting complication in Prior Art attempts to produce a workable closed cycle engine system.

It is also desirable to adapt conventional, air-aspirated engines for this application. The significant costs associated with the design, development and production, of a highly engineered product have been amortized by the engine builder making the unit cost affordable. Also, there exists a broad spectrum of commercial engines available to choose from that can be adapted for closed cycle operation using this invention. The best engine can therefore be matched to the job. An example of such an engine is the conventional diesel, either 4-stroke cycle or 2-stroke cycle that is widely used in marine, transportation and stationary power applications. However, this invention is applicable to Otto, Brayton and Sterling cycle engines equally as well.

The typical diesel 4-stroke cycle begins with the intake stroke ingesting air from the atmosphere, which is approximately 79% nitrogen and 21% oxygen. The following compression stroke raises the temperature of this gas to ignition temperature; fuel is injected and the subsequent combustion process consumes the fuel, all or part of the oxygen and the sensible heat released raises the temperature of the product gases (Principally $N_2$ with lesser amounts of $CO_2$ and $H_2O$). At maximum theoretical efficiency, a stoichiometric ratio of fuel and $O_2$ exists and only $CO_2$ and $H_2O$ will result from combustion; however, the exact ratio of oxygen and fuel required for complete combustion seldom exists, and small amounts of unused $O_2$ and Carbon Monoxide (CO) are by present in the working gas exhaust, which is principally $N_2$. This high-pressure gas forces the piston down on the power stroke. At the bottom of piston travel the exhaust valve opens; the subsequent exhaust stroke purges the cylinder and the cycle repeats starting with the intake stroke. The high pressure of this mixed gas resulting from combustion in a confined space, the engine combustion chamber, accomplishes work on the subsequent power stroke by moving a piston-crank assemble, by rotating a turbine wheel or causing other mechanical or electrical apparatus to function. The engine typically drives a pump, electrical generator or mechanical transmission to accomplish useful work.

In an engine operating in an open environment new air is ingested and the exhaust is vented to the atmosphere at each cycle. The earth's atmosphere is essentially an infinite source of $O_2$ and an infinite sink or buffer for the exhaust. However, in a closed system the buffer volume is severely restricted and exhaust gas must be retained, processed and recirculated under exacting control as part of the engine operating process. $O_2$ must be replenished from secondary storage. The gamma factor of the gas ingested on each intake stroke must be maintained essentially constant by removing excess combustion byproducts from the exhaust. The gamma factor is the ratio of specific heat at constant volume over the specific heat at constant pressure and is succinct to a given gas or mixture of gasses. The inert gas, $N_2$, that is the principal component in the exhaust gas, must be reconditioned to establish the required gamma value by removing the combustion byproducts, $CO_2$ and $H_2O$. It then can be recirculated. Oxygen and fuel are added as necessary.

2. Description of Prior Art

Most commercial engines are designed for $N_2$ to be the principal component of the working gas. If the quantity of $CO_2$ or $H_2O$ in the recirculated gas is allow to build up by not effectively removing the excess, the gamma value will change which will adversely alter combustion temperature and pressure. This can cause damage to the engine or prevent the engine from functioning as intended. Precise control of the gamma value and mass-ratio of inert gas, oxidizer, water vapor and fuel is essential for an engine to function as it has been designed. The major difficulty involved in closed cycle system has been in separating the $CO_2$ from the working inert gas. Another, third, inert gas has been used as a diluent in this process to correct the gamma value of the mix. Some Prior Art processes use Argon, Neon or other inert gas as a diluent, however, separating the $CO_2$ from two mixed inert working gasses further complicate the exhaust reconditioning process.

Prior Art:

Closed Cycle Rankine Cycle Steam Engine; U.S. Pat. No. 4,698,974; to the Garrett Corporation, Oct. 13, 1987, describes a steam turbine propulsion system enclosed within a pressure vessel. In its intended use Hydrogen ($H_2$) and Oxygen ($O_2$) are combined to produce superheated steam as the combustion byproducts. $H_2$ is formed by reaching water with a solid metal fuel and $O_2$ is delivered from high-pressure tank storage inside the pressure vessel. The only apparent similarity is that this steam turbine system uses a pressure vessel.

Prior Art:

Apparatus and Method for Energy Conversion Using Gas Hydrates; U.S. Pat. No. 5,613,362; to Billy D. Dixon, Mar. 25, 1997, describes a system enclosed in two (2) separate pressure vessels that uses the nearly isothermal compression of the gases associated with hydrates to produce energy and a differential gas pressure capable of doing work. The only apparent similarity is the use of pressure vessels as containments.

Prior Art:

Closed Cycle Rankine Cycle Steam Engine; U.S. Pat. No. 4,698,974; to the Garrett Corporation, Oct. 13, 1987, describes a steam turbine propulsion system enclosed within a pressure vessel. In its intended use Hydrogen ($H_2$) and Oxygen ($O_2$) are combined to produce superheated steam as the combustion byproducts. $H_2$ is formed by reaching water with a solid metal fuel and $O_2$ is delivered from high-pressure tank storage inside the pressure vessel. The only apparent similarity is that this steam turbine system uses a pressure vessel.

Prior Art:

Closed Cycle Engine; U.S. Pat. No. 4,674,463; to Cosworth Engineering LTD, Jun. 23, 1987, has attempted to control the quality of recirculated gas by removing some of the excess exhaust byproducts by solvent absorption. A second inert, or diluent gas is introduced, Argon (Ar), in a complicated approach to preserve the gamma value of the recirculated working gas. Excess $H_2O$ is cooled, condensed and removed by conventional processes.

Prior Art:

Closed Cycle Power System Process; U.S. Pat. No. 3,658,043; to Aerojet-General Corporation, Aug. 20, 1969, excess $CO_2$ is removed by chemical conversion using alkaline metals and caustic solutions. Hydrogen ($H_2$) and water vapor are added in an attempt to preserve the gamma value of the ingested gas.

Prior Art:

Closed Cycle Power System; U.S. Pat. No. 5,016,599; to Cosworth Deep Sea Systems LTD, May 30, 1990, attempted to remove excess $CO_2$ by compressing the mixed exhaust gas and injecting it into water where it is dissolved into solution. The pressure of this solution is subsequently reduced allowing much of the inert gas to flash quickly out of solution leaving some of the carbon dioxide in solution as carbonated water; which is then disposed of by pumping it overboard. Some of the inert gas is lost in this effluent as well. Both factors make regulation of the gamma value of the recirculated gas difficult to control, particularly if the load on the engine is variable. This system however, is not a true closed system, as effluent water must be discharged overboard.

Prior Art:

Closed Cycle Power System; U.S. Pat. No. 5,177,952; to Rockwell International Corporation, Jan. 12, 1991, uses alkaline metal superoxide to react with water, produce hydrogen ($H_2$) gas and metal hydroxide. The hydroxide then reacts with and removes some of excess carbon dioxide. The $H_2$ gas produced is used as fuel in this process. Water vapor becomes the principal working gas. This system is also complex, difficult to control and costly to sustain because the chemicals are expensive and dangerous to handle.

The various closed cycle engine systems heretofore have used complex processes, both mechanical and chemical, to deal with the $CO_2$ byproducts which must be removed form the exhaust in order to retain the gamma value of the ingested gas and therefore be able to use a commercial internal combustion engine for the proposed closed cycle power generating system. These systems have known disadvantages:

A. The commercial engines available presume a gamma value of ingested gas to be that of a 79/21% ratio of $N_2$ and $O_2$; or that of standard air. This value is difficult to maintain when the combustion byproduct, $CO_2$, is mixed with the working gas, $N_2$, and must be removed or separated.

B. The design assumes the absolute pressure of ingested air will be at or near atmospheric pressure (14.7 psia, 1080 bar)

C. That the combustion byproducts, $CO_2$ and $H_2O$, must be removed from the $N_2$ in the exhaust in order for the recirculated gas to function in the engine.

D. That hazardous, expensive chemical reactants or solvent absorption are the methods of choice for removing excess $CO_2$.

E. These engines do not respond quickly to variable engine loads.

DRAWINGS AND FIGURES

FIG. 1 is a simple schematic that shows the functional relationship of the system components and will be useful in understanding operation.

FIG. 2 is the legend to describe the numbered components in FIG. 1

DESCRIPTION AND OPERATION (Reference FIGS. 1 & 2)

A typical embodiment of the present invention is shown in FIG. 1 (Schematic). The legend for the items described in FIG. 1 is on FIG. 2.

The internal enclosure 36A is the sealed, gas tight, pressure vessel that encapsulates the closed cycle engine 38 and its supporting auxiliary equipment. The external 36B or outside enclosure and vibration isolators 36D serve to form a sealed annulus that can be evacuated and therefore isolate the sound produced by engine operation and prevent it from being transmitted into the spaces and structure housing the system. The absolute pressure of the free space within the enclosure 36A is the sum of the partial pressures of the gasses contained therein. The partial pressure of $O_2$, is that required when ingested in the engine intake stroke for a given power level to support combustion of the specific mass of fuel subsequently injected. Controlling the partial pressure of the working gas, $CO_2$, within enclosure 36A ensures that the required mass of $CO_2$ is ingested on the intake stroke to absorb the heat of combustion and be raised, along with combustion product water vapor, to the proper temperature and pressure within the combustion chamber to initiate and complete the power stroke. Controlling the partial pressure of the oxidizer, gaseous $O_2$, within enclosure 36A ensures the required mass of $O_2$ is ingested on the intake stroke to promote complete combustion of the fuel subsequently injected. The source of replenishment $O_2$ can be stored as a high-pressure gas in flasks, as liquid $O_2$ or from the reduction of chlorate compounds.

To Follow the Cycle: $CO_2$, $O_2$ and $H_2O$ as vapor, at ambient temperature, are ingested by the engine intake 20. Combustion occurs in the engine 38 which delivers useful power.

Hot $CO_2$ and $H_2O$ combustion byproducts, are exhausted from the engine and delivered by pipe 22 into the receiver plenum of the exhaust cooler-condenser 24. Circulating water pump 30, via control valve 30B, sprays cool water directly into this hot exhaust to cool it. The byproduct water is condensed out of the exhaust and collects along with the recirculating condensate spray water in the reservoir 24. The small amount of $CO_2$ dissolved in water as $H_2CO_3$ will be neutralized in the reservoir by consumable anodes. Waste heat in the reservoir is further removed by the cooling system 42. The cooled $CO_2$ exhaust is stripped of the residual condensate water as it passes through the discharge side of the cooler-plenum and into enclosure 36A where it will be recycled. Excess $CO_2$ produced by combustion will slowly raise the absolute pressure within enclosure 36A, which pressure sensor 34 controls by engaging and disengaging, or modulating, the $CO_2$ compressor 28. Compressor suction is taken from the discharge side of exhaust in plenum 24, which has been nearly depleted of $O_2$ by combustion. This will minimize the quantity of $O_2$ removed from the enclosure as compressor 28 removes excess exhaust gas from the plenum 24 and transfers it to $CO_2$ storage in the secondary enclosure 50. The remaining exhaust passes into the primary enclosure 36A. $O_2$ is replenished and mixed with $CO_2$ in enclosure 36A as required to maintain the correct $O_2$ partial pressure for any given engine power setting. Excess byproduct water collects in the condensate reservoir 24. When above a certain level, valve 30A opens and excess water is removed by condensate pump 30. Fuel injector delivery is modulated by $PO_2$ sensor 34 and fuel control module 40. Engine power is delivered via an electrical generator, a pump or direct shaft. Penetrations in the enclosures 36A and 36B are appropriately sealed if mechanical transmission is employed.

Excess exhaust gas is compressed and delivered to the secondary storage system 50. At elevated pressure and room temperature, $CO_2$ liquefies; however, CO from incomplete combustion, carry-over $O_2$, trace and inert non-condensable gasses will accumulate above the liquid $CO_2$ surface. By returning this mixed gas back into the primary enclosure 36A it will be ingested by the engine 38 and will be recycled. The non-condensable gas reclaim valve, 51, controls and maintains $LCO_2$ pressure in the secondary enclosure 50 by bleeding the non-condensable gasses back to the primary enclosure 36A.

The engine 38 is capable of delivering the desired output over its full operating power o range with this invention and essentially any commercial diesel engine, which is the preferred embodiment, can be easily adapted for use in this invention.

Conclusion, Ramifications and Scope

Accordingly, a reader skilled in the art will understand that this invention allows close control of the individual partial pressure of the principal working gas, $CO_2$, and of the oxidizer, $O_2$. Further that the ability to control partial pressure permits $CO_2$ to be used as the working gas in the closed-cycle engine. Also that regulating enclosure partial pressures insures that the correct quantity, or mass of both the working gas and oxidizer will be ingested on the intake stroke. Partial pressure control will therefore allow the gamma value of the intake gas to be actively regulated in near real-time. This will allow the engine to perform efficiently in a closed cycle engine system using $CO_2$ as the primary working gas.

Furthermore the $CO_2$ closed-cycle engine system:

Permits the engine and its auxiliary machinery to be sound and vibration isolated Promotes maximum engine and system efficiency by consuming all of the $O_2$ supplied to the engine enclosure by recovering that $O_2$ ingested by the excess $CO_2$ exhaust gas compressor. The recycling system will also feed unburned hydrocarbon gases back to the engine where they will be consumed as fuel.

Permits exactly matching the mass of fuel injected with the mass of $O_2$ required to promote more complete combustion at any given engine power setting. This also permits close regulation of peak combustion temperature and pressure.

Provide for a simple and efficient method of removing excess combustion byproduct $CO_2$ and water from the enclosure.

Provides a simple method of neutralizing byproduct carbonic acid

Is a system that, by virtue of being completely sealed, is non-polluting and environmentally friendly.

Requires only a source of gaseous $O_2$ and fuel to operate once the enclosure has been purged of atmospheric gasses and charged with $CO_2$.

Provides liquid $CO_2$ under pressure as a byproduct that can be used for auxiliary purposes such as deballasting submarine tanks, fire fighting or expansion for cooling purposes.

Although this description contains many specific applications they should not be constructed to limit the scope of this invention, but rather to provide some of the presently preferred embodiments of this invention. For example the engine can be any size and type of Diesel, Otto, Sterling or Brayton cycle system. The enclosure can be incorporated into the structure of a submarine, submersible vehicle or other marine vessel or in the structure of buildings and enclosures for terrestrial use.

The scope of the invention should be determined by the appended claims and their legal equivalents, rather than by examples given.

Summary

In accordance with the present invention a closed-cycle engine system is configured to operate with carbon dioxide ($CO_2$) as the principal working gas. Oxygen replenishment is obtained from outside storage and supply. Residual exhaust byproducts, excess $CO_2$ and water, are removed from the system. Provision is made to preserve the thermodynamic characteristics vital to engine operation in a closed environment.

What is claimed is:

1. A heat engine system for producing power in a totally closed or semi-closed environment whereby the primary working gas, carbon dioxide, is salvaged from engine exhausts and recycled or reused in subsequent combustion cycles:

a) said engine system selectively adaptable with at least one of Diesel, Otto, Sterling and Brayton cycle engine systems said engine system further comprising;

b) a gas-tight primary enclosure 36A for containing the heat engine of the system c) an oxidizer for adding additional oxygen to the working gas within the primary enclosure and mixed with the working gas to preserve the gamma value required by said engine at any particular power setting;

d) means for precisely controlling the molecular mass of said oxidizer and of said working gas, or the individual partial pressure of each, to promote complete combustion of the fuel and to control peak pressure and temperature of the working ga;

e) a fuel control module 40 and a pressure sensor 34 for modulating fuel injector delivery so that the precise quantity of fuel required to promote complete combustion with the mass of said oxidizer can be controlled at any given power setting of said engine;

f) means for controlling the partial pressure of $CO_2$ and the partial pressure of $O_2$ individually and exclusively prior to this mixed gas being ingested on the intake stroke of said engine;

g) a secondary gas-tight enclosure 36B being located outside said primary enclosure, said secondary enclosure being erect and resiliently isolated around the primary enclosure, air being evacuated in an annulus formed between said enclosures so that much of the acoustic and vibrational energy generated by said engine will not be transmitted into a compartment in which said engine is located nor will vibrational or acoustic energy be transmitted to the compartment structure;

h) a compressor for compressing the excess byproduct $CO_2$ produced by combustion in said engine until the $CO_2$ is liquefied to promote fractionation and separation of non-condensable gases including CO, $O_2$, and delivering said gases into a $CO_2$ tank, means for reclaiming said gases by venting the non-condensable gases accumulated in the $CO_2$ tank back to said primary enclosure where they will be recycled through said engine thereby reclaiming unburned fuel and oxidizer;

i) means for providing required oxidizer, oxygen from storage in either liquid form, gaseous form, or from the reduction of chlorate compounds.

* * * * *